US006245978B1

(12) United States Patent
Stevens

(10) Patent No.: US 6,245,978 B1
(45) Date of Patent: Jun. 12, 2001

(54) KEYBOARD MUSICAL PERCUSSION INSTRUMENT TONE BAR SUSPENSION

(75) Inventor: Leigh Howard Stevens, 392 Kirby Ave., Elberon, NJ (US) 07740

(73) Assignee: Leigh Howard Stevens, Elberon, NJ (US)

( * ) Notice: Subject to any disclaimer, the term of this patent is extended or adjusted under 35 U.S.C. 154(b) by 0 days.

(21) Appl. No.: 09/461,544

(22) Filed: Dec. 15, 1999

(51) Int. Cl.[7] ..... G10D 13/08
(52) U.S. Cl. ..... 84/402; 84/403
(58) Field of Search ..... 84/402, 403, 102; 446/397, 418, 298

(56) References Cited

U.S. PATENT DOCUMENTS

| | | | | |
|---|---|---|---|---|
| 1,166,746 | | 1/1916 | Deagan . | |
| 1,708,495 | | 4/1929 | Claiborne . | |
| 2,499,113 | | 2/1950 | Rowe | 84/403 |
| 2,943,527 | * | 7/1960 | Hanert | 84/403 |
| 3,138,986 | | 6/1964 | Musser | 84/410 |
| 3,633,453 | | 1/1972 | Musser | 84/403 |
| 3,705,527 | | 12/1972 | Burnham | 84/403 |
| 3,731,580 | | 5/1973 | Suzuki | 84/403 |
| 5,686,679 | | 11/1997 | Nakano et al. | 84/402 |

OTHER PUBLICATIONS

*Malletech Concert Keyboards* , "Concert Glockenspiels –Models M2.6g and M2.5G ", (Marimba Productions, Inc., 1991), 3 pgs.

* cited by examiner

*Primary Examiner*—Shih-Yung Hsieh
(74) *Attorney, Agent, or Firm*—Fish & Richardson P.C.

(57) ABSTRACT

In a keyboard musical percussion instrument having a series of tone bars mounted to at least first and second, spaced-apart support rails, each tone bar having a body with first and second nodes of its fundamental mode of vibration (Node A and Node B), Node B being spaced from Node A along a longitudinal axis of the tone bar body, and the body defining a bottom surface and a mounting hole formed in the bottom surface at Node A, a tone bar suspension assembly for mounting a tone bar includes first and second suspension bumpers extending from the first support rail and having upper suspension surfaces to engage the bottom surface of the body at spaced apart locations in a plane generally transverse to the longitudinal axis of the body at Node B, and a suspension pin extending from the second support rail to engage in the mounting hole. A keyboard musical percussion instrument employing the tone bar suspension assembly, and methods for mounting a tone bar and adjusting tone bar ring time are also described.

26 Claims, 2 Drawing Sheets

KEYBOARD MUSICAL PERCUSSION INSTRUMENT TONE BAR SUSPENSION

FIELD OF THE INVENTION

The field of the invention is keyboard musical percussion instruments and acoustics.

BACKGROUND OF THE INVENTION

A category of musical instruments known as "keyboard percussion instruments" includes marimbas, vibraphones, xylophones and glockenspiels. The "keys" on a keyboard percussion instrument are known as "tone bars." A basic feature of a keyboard musical percussion instrument is a suspension system that holds the tone bars in place, while allowing them to ring freely. Various types of suspension systems have been developed.

In the earliest xylophones, the tone bars were suspended on strips of straw. For this reason, they were sometimes called a "stroefiddle" or "straw fiddle." Beginning in the early part of this century, the tone bars of keyboard musical percussion instruments were similarly suspended on strips of wool felt. In many cases, the bars of these early instruments were not drilled. Instead, they were held in place on a frame by crisscrossed straps or string. Although such straw or felt suspension systems are no longer used on marimbas, xylophones and vibraphones, in some glockenspiels with steel tone bars, felt strips are still used under the tone bars.

The earliest wooden keyboard percussion instruments manufactured in North America, i.e., the xylophone and the marimba, used a suspension system developed in Central America during the 19th century. This system employed horizontal holes drilled entirely through the width of the tone bar at the two average nodal points of the bar. (A nodal point, or non-vibrating point, on a percussive tone bar is typically located approximately one quarter bar length from each end of the bar.) After all of the tone bars are drilled for an entire keyboard, i.e., two holes per bar, a string or cord was passed through the holes. The entire keyboard was then suspended on a series of "stand-offs" or "bar posts" located between each tone bar. This drill-and-string suspension system is still used on professional-quality marimbas and xylophones.

In the drill-and-string system, twice the width of the tone bar is in contact with the suspension cords. Thus, in the case of a low-range marimba bar 3.5 inches wide, 7 inches of tone bar are in contact with the suspension cord. This extensive contact produces a tone-dampening effect. In addition, the density, grain, elasticity and growth patterns of wood inevitably vary, and the non-uniform properties of a wooden tone bar can produce non-uniform, unpredictable nodal paths. Any undesirable dampening resulting from contact with the suspension cord becomes more pronounced in wooden bars, because the cord is frequently in contact with live, i.e., vibrating, regions of the bar. Other disadvantages of a drill-and-string suspension system include cord breakage, audible vibration of the cord against the tone bar, and the considerable manufacturing expense associated with drilling two holes in each of as many as sixty-one bars (on a five-octave marimba) made of steel or very hard wood.

More recently, in many commercial musical keyboard percussion instruments, the tone bars are attached upon each of the pair of rails by a screw engaged loosely through a hole extending from the top surface, through the tone bar, into the respective support rail therebelow, the screws being located at each of the two nodes of the fundamental mode of vibration, i.e., at "Node A" and "Node B" of tone bar.

In a prior art commercially available glockenspiel, each tone bar is supported at four points by a pair of bumpers resting on each of a pair of support rails, with the tone bar secured by a pin extending from one rail into a vertical through hole in the tone bar. The pairs of bumpers and the pin are located at each of the two nodes of the fundamental mode of vibration, i.e., at "Node A" and "Node B" of tone bar.

SUMMARY OF THE INVENTION

According to one aspect of the invention, in a tone bar suspension assembly for mounting a tone bar of a keyboard musical percussion instrument having a series of tone bars supported by at least one pair of spaced-apart support rails, each tone bar having a tone bar body with first and second nodes of its fundamental mode of vibration (Node A and Node B) spaced from each other along a longitudinal axis of the tone bar body, and the tone bar body defining a bottom surface and a mounting hole formed in the bottom surface at Node A of the tone bar body, the tone bar suspension assembly comprises first and second suspension bumpers extending from a first support rail of the pair of support rails and having upper suspension surfaces to engage the bottom surface of the tone bar body at spaced apart locations in a plane generally transverse to the longitudinal axis of the tone bar body at Node B, and a suspension pin extending from a second support rail of the pair of support rails to engage in the mounting hole defined in the bottom surface of the tone bar body at Node A.

According to another aspect of the invention, a keyboard musical percussion instrument comprises at least a first pair of a first support rail and a second support rail, the first support rail being spaced from the second support rail; a series of tone bars, each tone bar comprising a tone bar body with first and second nodes of its fundamental mode of vibration (Node A and Node B) spaced from each other along a longitudinal axis of the tone bar body, and the tone bar body defining a bottom surface and a mounting hole formed in the bottom surface at Node A; and a tone bar suspension assembly for mounting the series of tone bars to the first and second, spaced-apart support rails, the tone bar suspension assembly comprising first and second suspension bumpers extending from the first support rail and having upper suspension surfaces to engage the bottom surface of the tone bar body at spaced apart locations in a plane generally transverse to the longitudinal axis of the tone bar body at Node B, and a suspension pin extending from the second support rail to engage in the mounting hole.

Preferred embodiments of this aspect of the invention may include one or more of the following additional features. The mounting hole is a blind hole. The keyboard musical percussion instrument further comprises a positioning pin extending from the first support rail between opposed side surfaces of adjacent tone bars. Preferably, the positioning pin further comprises an elastic cap mounted thereupon and disposed between the opposed side surfaces of the adjacent tone bars. The first support rail is pivotable relative to the second support rail for adjustment of angular relationship of the first support rail to the second support rail. The keyboard musical percussion instrument further comprises a second pair of a third support rail and a fourth support rail, the third support rail being spaced from the fourth support rail, and the first and second support rails supporting a first set of tone bars and the third and fourth support rails supporting a second set of tones bars. The second and third support rails are fixed upon the instrument, and the first and fourth support rails are pivotably mounted upon the instrument at a first end, the first support rail being pivotable relative to the second support rail, for adjustment of angular relationship of the first support rail to the second support rail, and the fourth support rail being pivotable relative to the third support rail, for adjustment of angular relationship of the fourth support rail to the third support rail. The keyboard musical percussion instrument further comprises means for adjustment of the angular relationship of the first support rail to the second support rail. Preferably, the angular relationship of the first support rail to the second support rail is between about 4° and about 10°. The keyboard musical percussion instrument further comprises means for adjustment of the angular relationship of the fourth support rail to the third support rail. Preferably, the angular relationship of the fourth support rail to the third support rail is between about 4° and about 10°.

Preferred embodiments of both aspects of the invention may include one or more of the following additional features. The first and second suspension bumpers and the suspension pin support the tone bar body upon the first and second, spaced-apart support rails with three points of contact. The suspension pin extends generally vertically from the second support rail. The suspension pin further comprises an elastic cap mounted thereupon. The suspension pin, with or without the elastic cap, defines a point surface disposed for supporting engagement with the tone bar body within the mounting hole. The upper surface portions of the suspension bumpers are generally conical, each terminating in a generally pointed tip. The suspension bumpers are resilient, and may be elastic. Also, the elastic cap may preferably be formed of a material selected from the group consisting of rubber, felt and plastic, selected, e.g., from the group consisting of poly-ethylene, poly-propylene, poly-vinyl-chloride, poly-urethane, poly-urea and nylon; and the suspension bumpers may preferably be formed of a material selected from the group consisting of rubber, felt and plastic, selected, e.g., from the group consisting of poly-ethylene, poly-propylene, poly-vinyl-chloride, poly-urethane, poly-urea and nylon.

According to yet another aspect of the invention, a method for mounting a tone bar in a keyboard musical percussion instrument having at least first and second, spaced-apart support rails, the tone bar having a tone bar body with first and second nodes of its fundamental mode of vibration (Node A and Node B), Node B being spaced from Node A along a longitudinal axis of the tone bar body, and the tone bar body defining a bottom surface and a mounting hole formed in the bottom surface at Node A, comprises the steps of: engaging the bottom surface, at Node B, at spaced apart locations in a plane generally transverse to the tone bar body longitudinal axis, upon upper mounting surfaces of first and second suspension bumpers extending from the first support rail, and engaging the mounting hole upon a suspension pin extending generally vertically from the second support rail.

According to still another aspect of the invention, in the keyboard musical percussion instrument having at least first and second, spaced-apart support rails, the first support rail being pivotable relative to the second support rail, and the tone bar having a tone bar body with first and second nodes of its fundamental mode of vibration (Node A and Node B), Node B being spaced from Node A along a longitudinal axis of the tone bar body, and the tone bar body defining a bottom surface and a mounting hole formed in the bottom surface at Node A, a method for adjusting the ring time of a tone bar of the keyboard musical percussion instrument when struck by a mallet comprises the steps of: mounting the tone bar to the first and second support rails by engaging the bottom surface, at Node B, at spaced apart locations in a plane generally transverse to the tone bar body longitudinal axis, upon upper mounting surfaces of first and second suspension bumpers extending from the first support rail and engaging the mounting hole upon a suspension pin extending generally vertically from the second support rail; and changing the angular relationship of the first support rail to the second support rail, thereby changing the location of the transverse plane of engagement of the bottom surface upon the upper mounting surfaces of first and second suspension bumpers along the longitudinal axis of the tone bar body, relative to Node B.

We have thus developed a tone bar suspension system with advantages including adjustable ring time, absence of holes in or fasteners upon the upper surfaces of the tone bars, easy removability of tone bars, and reduced manufacturing costs.

Unless otherwise defined, all technical and scientific terms used herein have the same meaning as commonly understood by one of ordinary skill in the art to which this invention belongs. In case of conflict, the present application, including definitions, will control.

Although methods and materials similar or equivalent to those described herein can be used in the practice or testing of the present invention, the preferred methods and materials are described below. The materials, methods, and examples are illustrative only and not intended to be limiting. Other features and advantages of the invention will be apparent from the detailed description, and from the claims.

DESCRIPTION OF THE PREFERRED EMBODIMENTS

Figure 1:
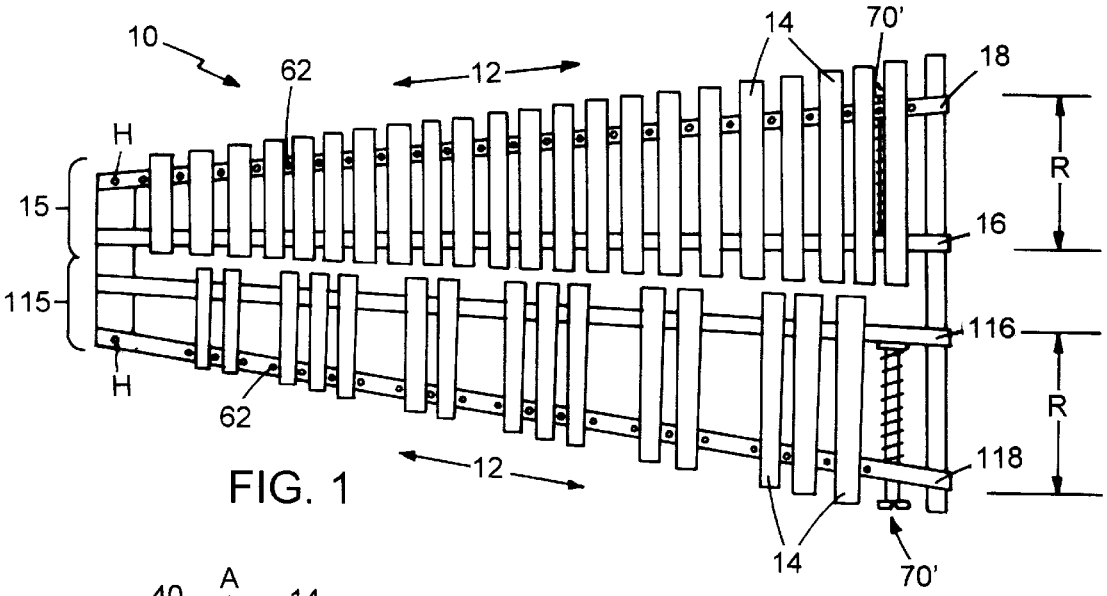
FIG. 1 is a perspective view of a keyboard musical percussion instrument, here, a xylophone, having a series of tone bars mounted on two pairs of support rails by a tone bar suspension assembly, all of the invention.

Referring to FIG. 1, a keyboard musical percussion instrument, e.g. a xylophone 10 is shown, or a marimba, vibraphone, or glockenspiel, has a series 12 of tone bars 14 mounted to a first pair 15 of first and second spaced-apart support rails 18, 16, respectively, and mounted to a second pair 115 of third and fourth spaced-apart support rails 116, 118, respectively, in a manner to permit each of the tone bars to vibrate and emit a ringing musical tone when struck with a mallet. The tone bars 14 vary progressively in length, so that each tone bar 14 produces a different note on a musical scale. Each tone bar 14 is supported on one of the pairs of support rails, i.e., a first, relatively pivotable support rail 18 and a second, fixed support rail 16, or a third, fixed support rail 116 and a fourth, relatively pivotable support rail 118.

Figure 3:
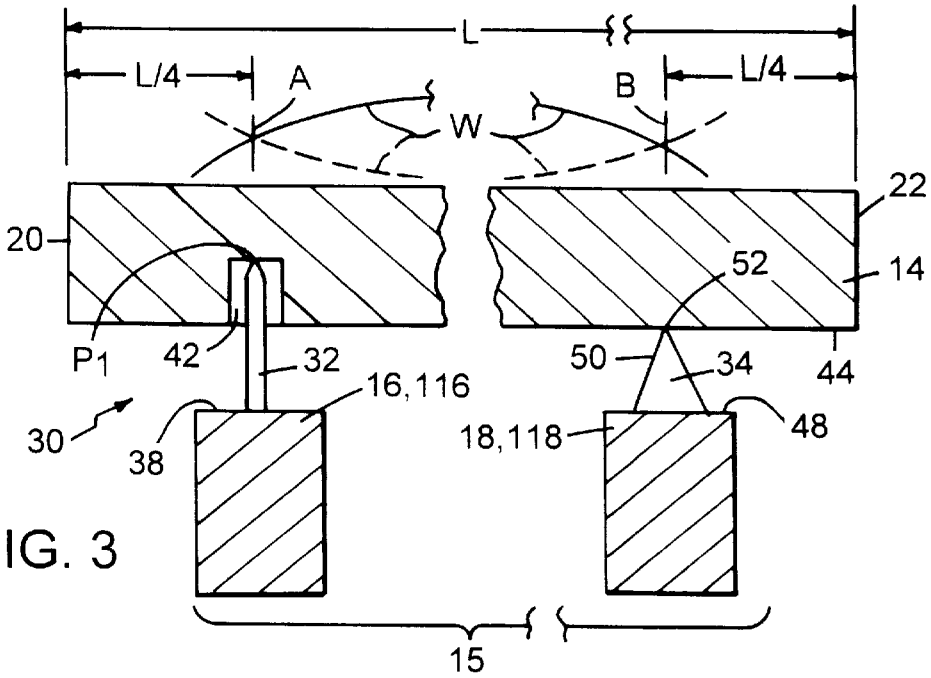
FIG. 3 is a side sectional view of a tone bar of FIG. 2 mounted by a tone bar suspension assembly of the invention, taken at the line 2—2 of FIG. 3.
Figure 2:
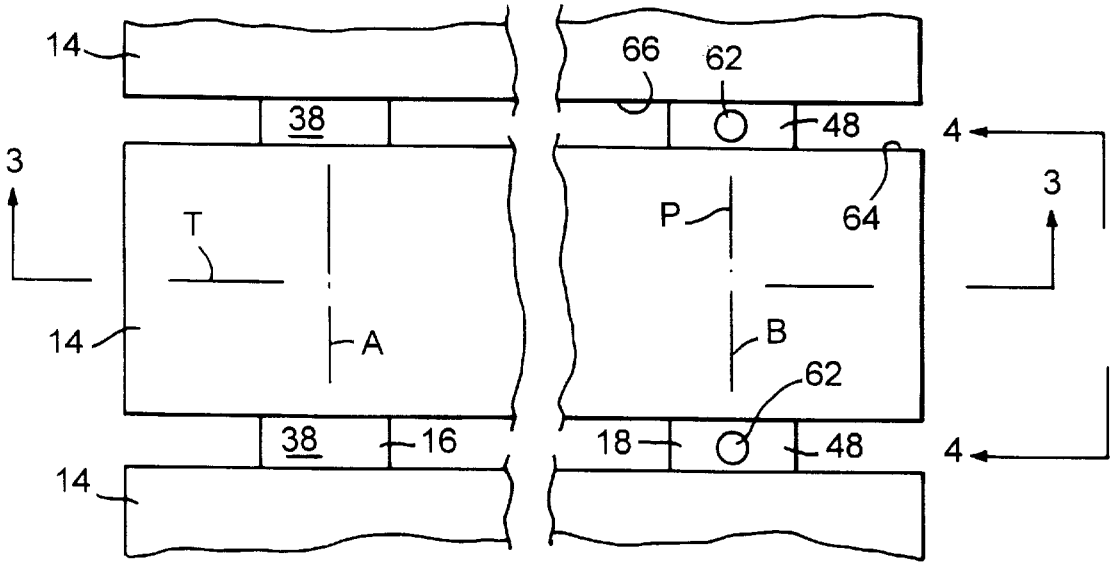
FIG. 2 is a plan view of a set of tone bars for a keyboard musical percussion instrument mounted by a tone bar suspension assembly of the invention.
Figure 4:
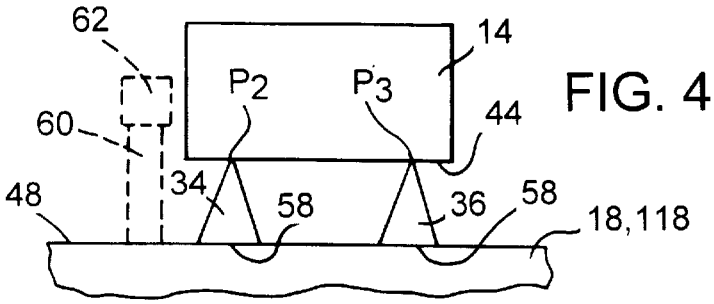
FIG. 4 is an end view of a tone bar supported by a tone bar suspension assembly of the invention, taken at the line 4—4 of FIG. 2.

Referring also to FIGS. 2–4, each tone bar 14 has a first node and second node of its fundamental mode of vibration, i.e., Node A, located about one quarter bar length, i.e. L/4, from a first end 20 of the tone bar, and Node B, located about one quarter bar length, i.e. L/4, from the second, opposite end 22 of the tone bar. The essentially straight support rails 18, 16 and 116, 118 are typically angled slightly, at angle, R, with respect to each other (e.g. preferably at about 4° to about 10° for a commercial keyboard musical percussion instrument with support rails of usual length), to accommodate the progressively differing length, L, of the tone bars 14 in the series 12.

Figure 5:
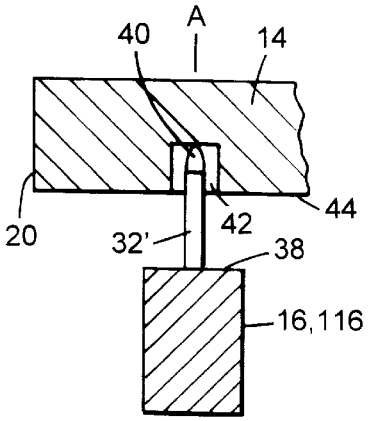
FIG. 5 is a side sectional view of a first end of the tone bar of FIG. 2, mounted by an alternate embodiment of a tone bar suspension assembly of the invention.

Referring to FIGS. 2 and 3, the tone bar 14 is supported by a tone bar suspension assembly 30 of the invention providing three points of contact, i.e. $P_1$, $P_2$, $P_3$, including a suspension pin 32 and a pair of suspension bumpers 34, 36. The suspension pin 32 is mounted to extend generally vertically from the upper surfaces 38 of the second and third fixed support rails 16, 116. Referring to FIG. 5, if the suspension pin 32' is steel, or other metal, a plastic cap 40 with a pointed tip is mounted over the tip of the pin 32', to avoid metal-to-metal contact, and also to minimize the surface area of contact. The pin 32 (in FIG. 5, pin 32' with cap 40), engages (inserts into) a blind mounting hole 42 formed, e.g., by drilling, into the underside or bottom surface 44 of the tone bar 14, at Node A, adjacent to the first end 20 of the tone bar. The mounting hole 42 has a diameter slightly larger than the diameter of the cap 40 on the pin 32', thus to allow the tone bar 14 to vibrate freely, e.g., when struck with a mallet. (If a non-metal suspension pin 32 is employed, a plastic cap 40 is not required, and the mounting hole 40 may be sized to receive only the pointed tip of the suspension pin 32.) As shown in FIGS. 3 and 4, at the opposite, second end 22, the tone bar 14 is supported by first and second suspension bumpers 34, 36 mounted upon the upper surface 48 of the first and fourth, pivotable support rails 18, 118. Each bumper has an upper support surface 50 ending in a conical tip 52 that engages the bottom surface 44 of the tone bar 14. The conical shape of the bumpers 34, 36 provides a relatively large surface area at the bumper base 54 for secure attachment of the suspension bumpers 34, 36 to the surface 38 of the second support rails 18, 118, and the conical tip 52 preferably terminates at a point, thereby to minimize the surface area in contact with the tone bar 14. For a glockenspiel, the suspension bumpers 34, 36 are preferably formed of rubber. For a marimba or xylophone, the suspension bumpers 34, 36 are preferably have the form of pointed felt pads.

Referring to again to FIG. 2, metal pins 60, with elastic caps 62 (shown also in dashed line in FIG. 4), extend from the upper surface 48 of the first and fourth, pivotable support rails 18, 118, between side surfaces 64, 66 of adjacent tone bars 14, to maintain the positions of the tone bars 14 along the first and fourth pivotable support rails 18, 118.

The elastic caps 40 mounted on the suspension pins 32, and the elastic caps 62 mounted on the positioning pins 60, are preferably formed of a material selected from the group consisting of rubber, felt and plastic, selected, e.g., from the group consisting of poly-ethylene, poly-propylene, poly-vinyl-chloride, poly-urethane, poly-urea and nylon. The suspension bumpers 34, 36 are preferably resilient (and may be elastic), and preferably formed of a material selected from the group consisting of rubber, felt and plastic, selected, e.g., from the group consisting of poly-ethylene, poly-propylene, poly-vinyl-chloride, poly-urethane, poly-urea and nylon.

To provide maximum ring time, the first and fourth pivotable support rails 18, 118 are positioned to place the suspension bumpers 34, 36 in contact with the bottom surfaces 44 of the tone bars 14 at Node B, with the bumpers 34, 36 spaced apart from each other in a plane, P, generally transverse to a longitudinal axis, T, of the tone bar body.

The exact position of Node B, i.e., the position providing maximum ring time, can be located, for example, by using the salt or sugar test, i.e. particles of salt or sugar sprinkled on the surface of the tone bar will gather at the first and second nodes (Node A and Node B) of the fundamental mode of vibration, i.e. the regions of least vibration (as represented in the wave diagram, W, shown in FIG. 3), when the tone bar is struck and permitted to vibrate, or by simple trial and error. Node B can then be marked for convenient future reference.

Figure 6:
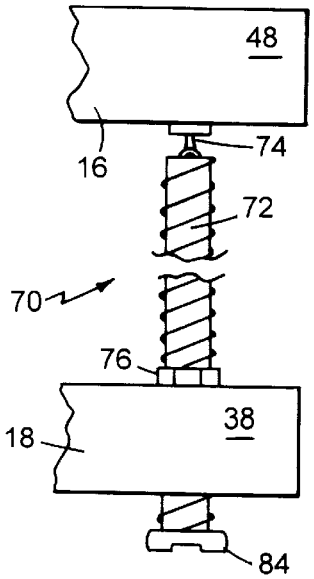
FIGS. 6 and 7 are alternate embodiments of means for adjusting the angular relationship of the pairs of support rails in a keyboard musical percussion instrument with tone bar suspension assembly of the invention.
Figure 7:
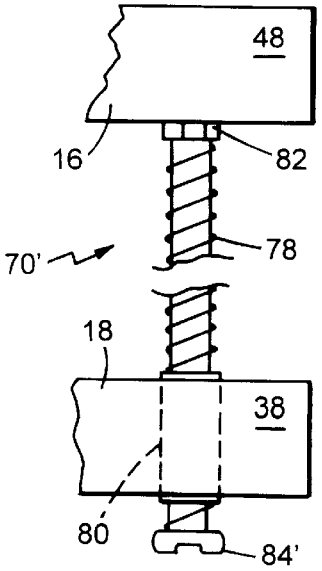

The angular positions of the first and fourth, pivotable support rails 18, 118 are adjusted by pivoting the support rails 18, 118 about pivot or hinge points, H (FIG. 1). Referring now to FIGS. 6 and 7, means for adjustment of the angular relationship between the first and second support rails 18, 16 (shown), and between the third and fourth support rails 116, 118, may have the form of a threaded rod and thumbscrew assembly 70, 70'. Adjustment of the angular position of the pivotable rail 18 relative to the fixed support rail 16 in turn adjusts the location of the plane, P, at which the bumpers 34, 36 contact the bottom surface 44 of the tone bar 14, relative to Node B. In a first embodiment (FIG. 6), the threaded rod and thumbscrew assembly 70 has the form of a threaded rod 72 attached at its end to the second, fixed support rail 16, e.g. at rotating eyelet 74, with the threaded rod 72 disposed in threaded engagement with the first, pivotable support rail 18, e.g. in threaded nut 76. Alternatively, in a second embodiment (FIG. 7), the threaded rod and thumbscrew assembly 70' has the form of a threaded rod 78 mounted to rotate relative to the second, fixed support rail 16, e.g., in sleeve 80, with the threaded rod 78 in threaded engagement with the first, pivotable support rail 18, e.g., in threaded nut 82. In both arrangements, rotation of thumbscrew 84, 84' attached to the outer end of the threaded rod 72, 78 results in adjustment of the angular relationship (angle, R) of the first, pivotable support rail 18 to the second, fixed support rail 16.

In some situations, it may be desirable to shorten (dampen) the ring time from the maximum ring time, i.e. the ring time occurring with the position of plane, P, of the points of contact $P_2$, $P_3$ of the suspension bumpers 34, 36 corresponding to Node B. This can be achieved in the keyboard musical percussion instrument 10 of the invention by adjusting the angular relationship, R, of the pivotable, first and fourth support rails 18, 118, respectively, to the fixed, second and third support rails 16, 116, respectively, thereby to move the plane, P, of contact of suspension bumpers 34, 36 with the underside or bottom surface 44 of the tone bar 14 relative to, i.e., away from, Node B. The degree of dampening increases as the spacing of the plane, P, of contact of suspension bumpers 34, 36 with the underside or bottom surface 44 of the tone bar 14 from Node B is increased. The easy adjustability of the pivotable, first and fourth support rails 18, 118 advantageously allows fine tuning of ring time, thus allowing achievement of maximum ring time, or selection of the precise degree of dampening desired for a particular piece of music.

Although horizontal dislocation of the tone bars 14 is resisted by the suspension pins 32 (or suspension pins 32'), the tone bars are easily placed onto, and lifted off of, the suspension pins 32 (or suspension pins 32') and suspension bumpers 34, 36. This advantageously avoids complicated arrangements of strings or cords, thereby simplifying manufacturing. Easy removal of the bars 14 also simplifies replacement of damaged bars 14 and disassembly of keyboard musical percussion instruments, e.g., for shipment. Manufacturing is further simplified by the absence of the requirement of drilling holes traversing the entire width of each tone bar 14.

A further advantage of the tone bar suspension assembly 30 of the invention is that it provides a smooth upper surface of the series of tone bars 12 (e.g. as shown in FIG. 2), since the need for irregularities such as holes or fasteners on the upper surfaces of the tone bars is avoided. Such irregularities are undesirable.

Having read the foregoing, one skilled in the art will readily understand the structure and operation of the present invention. The foregoing description, while setting forth the best mode presently contemplated by the inventor for making the invention, should be considered illustrative only, and not limiting in nature. It is to be understood that other embodiments are within the following claims. For example, other means can be employed for moving and securing the pivotable support rails 18, 118, e.g. the pivotable support rails 18, 118 may be mounted to slide along a non-threaded (smooth) rod, to be held at the desired position by a set screw or a clamp.

Also, the invention has been described with respect to keyboard musical percussion instruments having two pairs of support rails, and two sets of tone bars 14, which is the case for most commercial instruments. However, the invention may be embodied as well in keyboard musical percussion instruments of lesser commercial importance having a single pair of support rails, and one set of tone bars. An angular relationship of a different range may also be maintained between support rails of a keyboard musical percussion instrument with support rails of other than usual length.

What is claimed is:

1. A tone bar suspension assembly for mounting a tone bar of a keyboard musical percussion instrLument having a series of tone bars supported by at least one pair of spaced-apart support rails, each tone bar having a tone bar body with first and second nodes of its fundamental mode of vibration, namely, Node A and Node B, spaced from each other along a longitudinal axis of said tone bar body, and said tone bar body defining a bottom surface and a mounting hole formed in said bottom surface at Node A of said tone bar body, said tone bar suspension assembly comprising:

first and second suspension bumpers extending from a second support rail spaced from said first support rail of said pair of support rails and having upper suspension surfaces to engage said bottom surface of said tone bar body at spaced apart locations in a plane generally transverse to said longitudinal axis of said tone bar body at Node B, and a suspension pin extending from a second support rail of said pair of support rails to engage in said mounting hole defined in said bottom surface of said tone bar body at Node A.

2. The tone bar suspension system of claim 1, wherein said first and second suspension bumpers and said suspension pin support the tone bar body upon the first and second, spaced-apart support rails with three points of contact.

3. The tone bar suspension assembly of claim 1 or 2, wherein said suspension pin extends generally vertically from said second support rail.

4. The tone bar suspension assembly of claim 1, wherein said suspension pin further comprises an elastic cap mounted thereupon.

5. The tone bar suspension system of claim 1 or 4, wherein said suspension pin defines a point surface disposed for supporting engagement with the tone bar body within the mounting hole.

6. The tone bar suspension assembly of claim 1, wherein said upper surface portions of said suspension bumpers are generally conical, each terminating in a generally pointed tip.

7. The tone bar suspension assembly of claim 1 or 6, wherein said suspension bumpers are resilient.

8. A keyboard musical percussion instrument comprising:

at least a first pair of a first support rail and a second support rail, said first support rail being spaced from said second support rail;

a series of tone bars, each said tone bar comprising a tone bar body with first and second nodes of its fundamental mode of vibration, namely, Node A and Node B, spaced from each other along a longitudinal axis of said tone bar body, and said tone bar body defining a bottom surface and a mounting hole formed in said bottom surface at Node A; and a tone bar suspension assembly for mounting said series of tone bars to said first and second, spaced-apart support rails, said tone bar suspension assembly comprising first and second suspension bumpers extending from said first support rail and having upper suspension surfaces to engage said bottom surface of said tone bar body at spaced apart locations in a plane generally transverse to said longitudinal axis of said tone bar body at Node B, and a suspension pin extending from said second support rail to engage in said mounting hole.

9. The keyboard musical percussion instrument of claim 8, wherein said mounting hole is a blind hole.

10. The keyboard musical percussion instrument of claim 8, wherein said tone bar body is supported upon said first and second, spaced-apart support rails by said first and second suspension bumpers and said suspension pin with three points of contact.

11. The keyboard musical percussion instrument of claim 8 or 10, wherein said suspension pin extends generally vertically from said second support rail.

12. The keyboard musical percussion instrument of claim 8, wherein said suspension pin further comprises an elastic cap mounted thereupon.

13. The keyboard musical percussion instrument of claim 8 or 12, wherein said suspension pin defines a point surface disposed in supporting engagement with said tone bar body within said mounting hole.

14. The keyboard musical percussion instrument of claim 8, wherein said upper surface portions of said suspension bumpers are generally conical, each terminating in a generally pointed tip.

15. The keyboard musical percussion instrument of claim 8 or 14, wherein said suspension bumpers are resilient.

16. The keyboard musical percussion instrument of claim 8, further comprising a positioning pin extending from said first support rail between opposed side surfaces of adjacent tone bars.

17. The keyboard musical percussion instrument of claim 16, wherein said positioning pin further comprises an elastic cap mounted thereupon and disposed between said opposed side surfaces of said adjacent tone bars.

18. The keyboard musical percussion instrument of claim 8, wherein said first support rail is pivotable relative to said second support rail for adjustment of angular relationship of said first support rail to said second support rail.

19. The keyboard musical percussion instrument of claim 8, further comprising a second pair of a third support rail and a fourth support rail, said third support rail being spaced from said fourth support rail, and said first and second support rails supporting a first set of tone bars and said third and fourth support rails supporting a second set of tones bars.

20. The keyboard musical percussion instrument of claim 19, wherein said second and third support rails are fixed upon said instrument, and said first and fourth support rails are pivotably mounted upon said instrument at first ends, said first support rail being pivotable relative to said second support rail, for adjustment of angular relationship of said first support rail to said second support rail, and said fourth support rail being pivotable relative to said third support rail, for adjustment of angular relationship of said fourth support rail to said third support rail.

21. The keyboard musical percussion instrument of claim 18 or 20, further comprising means for adjustment of the angular relationship of said first support rail to said second support rail.

22. The keyboard musical percussion instrument of claim 18 or 20, wherein said angular relationship of said first support rail to said second support rail is between about 4° and about 10°.

23. The keyboard musical percussion instrument of claim 20, further comprising means for adjustment of the angular relationship of said fourth support rail to said third support rail.

24. The keyboard musical percussion instrument of claim 20 or 23, wherein said angular relationship of said fourth support rail to said third support rail is between about 4° and about 10°.

25. A method for mounting a tone bar in a keyboard musical percussion instrument having at least first and second, spaced-apart support rails, the tone bar having a tone bar body with first and second nodes of its fundamental mode of vibration, namely, Node A and Node B, Node B being spaced from Node A along a longitudinal axis of the tone bar body, and the tone bar body defining a bottom surface and a mounting hole formed in the bottom surface at Node A, said method for mounting a tone bar comprising the steps of:

engaging the bottom surface, at Node B, at spaced apart locations in a plane generally transverse to the tone bar body longitudinal axis, upon upper mounting surfaces of first and second suspension bumpers extending from the first support rail, and engaging the mounting hole upon a suspension pin extending generally vertically from the second support rail.

26. A method for adjusting the ring time of a tone bar of a keyboard musical percussion instrument when struck by a mallet, the keyboard musical percussion instrument having at least first and second, spaced-apart support rails, the first support rail being pivotable relative to the second support rail and the keyboard musical percussion instrument including means for adjusting the angular relationship of the first support rail to the second support rail, and the tone bar having a tone bar body with first and second nodes of its fundamental mode of vibration, namely, Node A and Node B, Node B being spaced from Node A along a longitudinal axis of the tone bar body, and the tone bar body defining a bottom surface and a mounting hole formed in the bottom surface at Node A, said method for adjusting the ring time a tone bar comprising the steps of:

mounting the tone bar to the first and second support rails by engaging the bottom surface, at Node B, at spaced apart locations in a plane generally transverse to the tone bar body longitudinal axis, upon upper mounting surfaces of first and second suspension bumpers extending from the first support rail and engaging the mounting hole upon a suspension pin extending generally vertically from the second support rail; and changing the angular relationship of the first support rail to the second support rail, thereby changing the location of the transverse plane of engagement of the bottom surface upon the upper mounting surfaces of first and second suspension bumpers along the longitudinal axis of the tone bar body, relative to Node B.

* * * * *